US007164877B2

(12) United States Patent
Murakami et al.

(10) Patent No.: US 7,164,877 B2
(45) Date of Patent: Jan. 16, 2007

(54) IMAGE FORMING APPARATUS

(75) Inventors: Susumu Murakami, Kyoto (JP); Yoshie Iwakura, Higashiosaka (JP); Takahiro Fukunaga, Sakurai (JP); Masanori Yamada, Nara (JP); Kuniaki Nakano, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 130 days.

(21) Appl. No.: 11/034,001

(22) Filed: Jan. 12, 2005

(65) Prior Publication Data

US 2005/0158074 A1 Jul. 21, 2005

(30) Foreign Application Priority Data

Jan. 16, 2004 (JP) ..... P2004-009112

(51) Int. Cl.
*G03G 15/08* (2006.01)

(52) U.S. Cl. ..... 399/121; 399/299

(58) Field of Classification Search ..... 399/121, 399/299, 300

See application file for complete search history.

(56) References Cited

U.S. PATENT DOCUMENTS 5,893,006 A * 4/1999 Kanno et al. ..... 399/13

2002/0018673 A1* 2/2002 Mizoguchi et al. ..... 399/299 X

FOREIGN PATENT DOCUMENTS

| | | |
|---|---|---|
| JP | 10-039651 | 2/1998 |
| JP | 11-015291 | 1/1999 |

* cited by examiner

*Primary Examiner*—David M. Gray
*Assistant Examiner*—Erika J. Villaluna
(74) *Attorney, Agent, or Firm*—Renner, Otto, Boisselle & Sklar, LLP

(57) ABSTRACT

An image forming apparatus includes a pair of optical sensing devices for monochrome image forming and full-color image forming which are disposed at the rear of the image forming apparatus and a pair of generally L-shaped light shielding members for monochrome image forming and full-color image forming which are mounted swingably on a rear side of an image transfer unit with one end of each light shielding member attached to one of two sliding members. When each of the sliding members moves back and forth, the light shielding member for monochrome image forming or full-color image forming, whichever applicable, swings and the relevant optical sensing device detects the other end of the light shielding member.

3 Claims, 6 Drawing Sheets

| | | OPTICAL SENSING DEVICE 30A | OPTICAL SENSING DEVICE 31A |
|---|---|---|---|
| MODE DETECTION | MONOCHROME MODE | OFF | OFF |
| | FULL-COLOR MODE | OFF | ON |
| | STANDBY MODE | ON | OFF |
| STATE OF IMAGE TRANSFER UNIT 200 (WHEN REMOVED) | | ON | ON |

FIG. 6

IMAGE FORMING APPARATUS

CROSS REFERENCE

This Nonprovisional application claims priority under 35 U.S.C. § 119(a) on Patent Application No. 2004-009112 filed in Japan on Jan. 16, 2004, the entire contents of which are hereby incorporated by reference

BACKGROUND OF THE INVENTION

The present invention relates to an image forming apparatus in which toner images formed on image carrying members through an electrophotographic image forming process are transferred onto such a recording medium as a sheet of printing paper, hereinafter referred to as the printing paper, by means of an endless belt, the image forming apparatus having a full-color mode and a monochrome mode for printing full-color and monochrome images, respectively, as well as a standby mode for performing standby processing operation. More particularly, the invention pertains to a sensor for detecting the currently selected mode of the image forming apparatus.

There is a growing need today for electrophotographic image forming apparatuses featuring not only monochrome but also full-color printing capabilities. Under these circumstances, electrophotographic full-color image forming apparatuses are being developed these days. Typically, a full-color image forming apparatus forms a printed image by using different color toners corresponding to multiple color image data obtained by separating a full-color image. Specifically, the full-color image forming apparatus reads (or scans) an original full-color image by using filters for the three additive primaries (red, green, blue) to obtain data on the original image, produces image data for the three primary colors (cyan, magenta, yellow) and black from the scanned data, develops visual color images using toners of the individual colors (including black) based on the image data, and reproduces the original full-color image by superimposing the developed color images, for example.

It is necessary for this kind of full-color image forming apparatus to perform an exposure process, a development process and an image transfer process for each color as well as alignment (registration) of the individual color images, which is critical. For this reason, the full-color image forming apparatus generally gives an impression that full-color image forming operation is too slow compared to monochrome image forming operation.

One example of a previous approach to the resolution of this problem is disclosed in Japanese Laid-open Patent Application No. H10-039651. This publication proposes a tandem-type full-color image forming apparatus which includes a rotatable endless belt made of semiconductor material, the endless belt having multiple image forming areas arranged in line along a turning direction of the belt on an outer surface thereof. In this full-color image forming apparatus, visual color images of different colors are formed on the individual image forming areas of the endless belt and transferred onto a sheet of printing paper to produce at least one full-color image while the endless belt turns once.

Another example of a conventional tandem-type full-color image forming apparatus employs an intermediate image transfer method, in which visual color images of different colors are formed on cylindrical surfaces of photosensitive drums, each of which serves as an image carrying member having an image forming area, and transferred onto an outer surface of an endless belt (intermediate transfer belt) with the individual visual color images overlaid exactly in register with one another. The color images superimposed on the outer surface of the endless belt are then transferred onto a sheet of printing paper to produce a full-color image.

One known example of the aforementioned tandem-type full-color image forming apparatus employing the intermediate image transfer method has a full-color mode for producing full-color images, a monochrome mode for producing monochrome images and a standby mode for performing standby processing operation.

FIGS. 1A, 1B and 1C are front views of an image transfer unit 200 used in the conventional tandem-type full-color image forming apparatus.

FIG. 1A shows a situation in which the image forming apparatus is in the full-color mode. In the image transfer unit 200 illustrated in FIG. 1A, all of vertically movable image transfer rollers 13A to 13D which are held by roller up/down arms 21A to 21D inside a loop-shaped moving path of an endless belt 11 descend so that an outer surface of the endless belt 11 is brought into contact with cylindrical surfaces of image carrying members (photosensitive drums) 101A to 101D for individual colors, respectively. Visual color images formed on the cylindrical surfaces of the individual image carrying members 101A to 101D based on image information separated into individual color components (including black) are transferred onto the outer surface of the endless belt 11 (primary image transfer) and then onto a sheet of printing paper (secondary image transfer).

FIG. 1B shows a situation in which the image forming apparatus is in the monochrome mode. In the monochrome mode, only the image transfer roller 13A facing the image carrying member 101A on which a visual black image is formed based on the image information descends so that the outer surface of the endless belt 11 is brought into contact with the cylindrical surface of the image carrying member 101A only. Subsequently, the visual black image is transferred from the cylindrical surface of the image carrying member 101A onto the outer surface of the endless belt 11 and then onto a sheet of printing paper.

FIG. 1C shows a situation in which the image forming apparatus is in the standby mode. In this mode, all of the image transfer rollers 13A to 13D ascend and the outer surface of the endless belt 11 comes apart from the cylindrical surfaces of the individual image carrying members 101A to 101D as illustrated.

The image transfer rollers 13A to 13D move up and down as peripheral surfaces of a first rotary cam 23A and a second rotary cam 23B are displaced as a result of rotary motion thereof. More specifically, when the first and second rotary cams 23A, 23B rotate, a sliding member 22A for monochrome image forming and a sliding member 22B for full-color image forming which are in contact with the peripheral surfaces of the rotary cams 23A, 23B move back and forth horizontally, whereby the roller up/down arms 21A to 21D swing and the image transfer rollers 13A to 13D move up and down.

The image forming apparatus further includes a monochrome image forming sensor 30 and a full-color image forming sensor 31 for detecting whether the image forming apparatus is in the full-color mode, the monochrome mode or the standby mode from the locations of the sliding members 22A and 22B. The monochrome image forming sensor 30 includes an optical sensing device 30A for monochrome image forming disposed inside the image forming apparatus and a light shielding member 30B disposed on a rear side of the image transfer unit 200 face to face with the optical sensing device 30A. Similarly, the full-color image forming sensor 31 includes an optical sensing device 31A for full-color image forming disposed inside the image forming apparatus and a light shielding member 31B disposed on the rear side of the image transfer unit 200 face to face with the optical sensing device 31A.

The light shielding member 30B is a generally L-shaped element of which one end is attached to the sliding member 22A. When the sliding member 22A moves back and forth, the light shielding member 30B swings and the other end of the light shielding member 30B interrupts light emitted by the optical sensing device 30A. Likewise, the light shielding member 31B is a generally L-shaped element of which one end is attached to the sliding member 22B. When the sliding member 22B moves back and forth, the light shielding member 31B swings and the other end of the light shielding member 31B interrupts light emitted by the optical sensing device 31A. When a light path of the optical sensing device 30A is blocked by the light shielding member 30B, the optical sensing device 30A outputs an "OFF" signal to a control unit (not shown) of the image forming apparatus. Also, when a light path of the optical sensing device 31A is blocked by the light shielding member 31B, the optical sensing device 31A outputs an "OFF" signal to the control unit. As the optical sensing device 30A and/or the optical sensing device 31A individually outputs the OFF signal in predetermined patterns, the control unit can recognize how the endless belt 11 is shaped (FIG. 1A, 1B or 1C), that is, in which mode the image forming apparatus is currently operated.

When the image transfer unit 200 is taken out of the image forming apparatus, the light shielding members 30B, 31B are also removed from the apparatus. In this state, the control unit can not recognize which mode is currently selected, because signals output from the optical sensing devices 30A, 31A are of the same pattern as in the standby mode. Therefore, the image forming apparatus is provided with a dedicated sensing device for detecting whether the image transfer unit 200 is mounted in position to prevent the image forming apparatus from beginning any image forming operation with the image transfer unit 200 removed therefrom.

In the aforementioned structure of the image forming apparatus employing the optical sensing devices 30A, 31A and the light shielding members 30B, 31B, the provision of the dedicated sensing device for detecting whether the image transfer unit 200 is installed in the image forming apparatus would result in an increase in manufacturing cost.

SUMMARY OF THE INVENTION

It is an object of the invention to provide an image forming apparatus including a sensing device for monochrome image forming and a sensing device for full-color image forming which are usable not only for detecting a currently selected mode of the image forming apparatus but also for detecting whether an image transfer unit is installed in the image forming apparatus.

According to a principal feature of the invention, an image forming apparatus having a full-color mode, a monochrome mode and a standby mode includes a removable image transfer unit, a full-color image forming sensor and a monochrome image forming sensor. The image transfer unit includes an endless belt forming a loop-shaped moving path, a plurality of full-color image transfer rollers located inside the endless belt, a full-color image transfer part moving mechanism including a sliding member which moves back and forth generally parallel to a fixed turning direction of the endless belt to raise and lower the full-color image transfer rollers, and a monochrome image transfer part moving mechanism including a sliding member which moves back and forth generally parallel to the turning direction of the endless belt to raise and lower the monochrome image transfer roller. The full-color image forming sensor detects the current position of the sliding member of the full-color image transfer part moving mechanism, while the monochrome image forming sensor detects the current position of the sliding member of the monochrome image transfer part moving mechanism. In this image forming apparatus, the moving path of the endless belt is selectively switched to one of three locations for the full-color mode, the monochrome mode and the standby mode as a result of ascending and descending motions of the full-color image transfer rollers and the monochrome image transfer roller. The image forming apparatus judges based on results of detection by the full-color image forming sensor and the monochrome image forming sensor whether the image forming apparatus is currently in the full-color mode for producing a full-color image, the monochrome mode for producing a monochrome image or the standby mode for performing standby processing operation and whether the image transfer unit is installed in the image forming apparatus.

These and other objects, features and advantages of the invention will become more apparent upon reading the following detailed description along with the accompanying drawings.

BRIEF DESCRIPTION OF THE DRAWINGS

FIG. 6 is a chart a pattern of signals output from optical sensors provided in the image forming apparatus of the embodiment.

DETAILED DESCRIPTION OF THE INVENTION

Figure 1A:
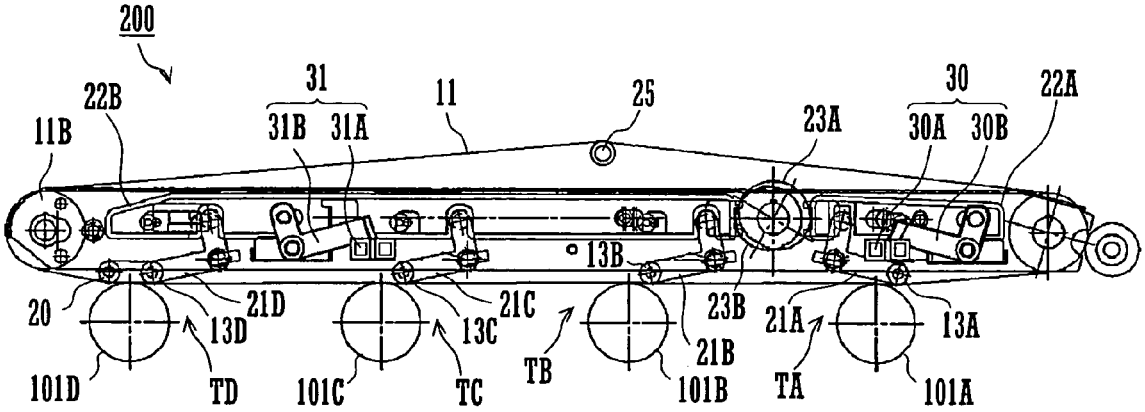
FIGS. 1A, 1B and 1C are front views showing the structure of an image transfer unit of a conventional image forming apparatus.
Figure 1B:
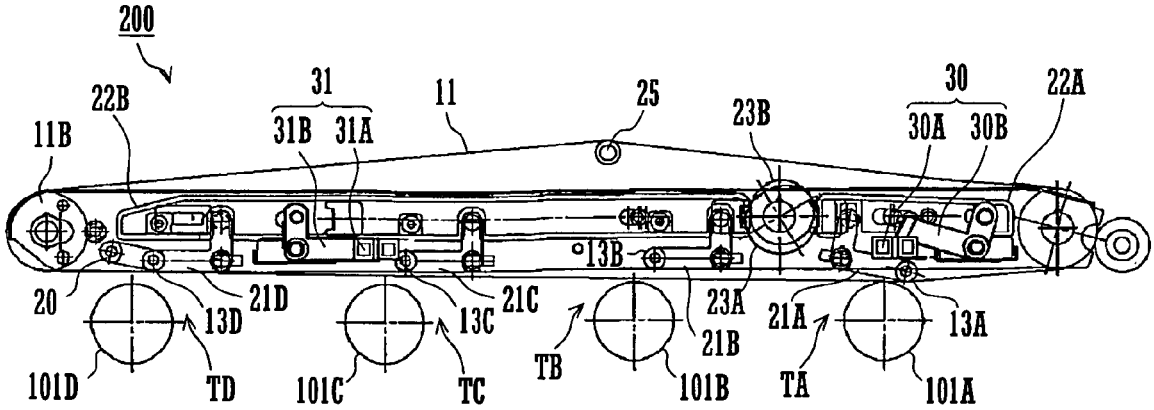
Figure 1C:
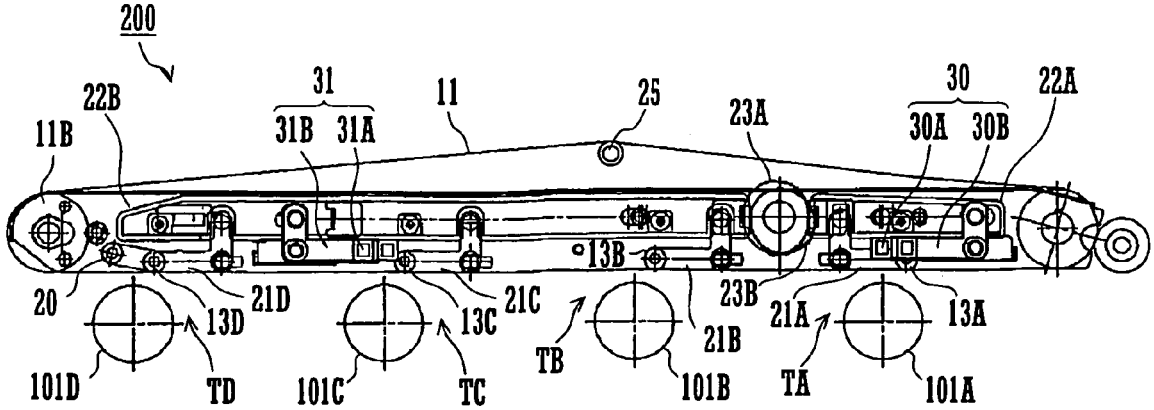
Figure 2:
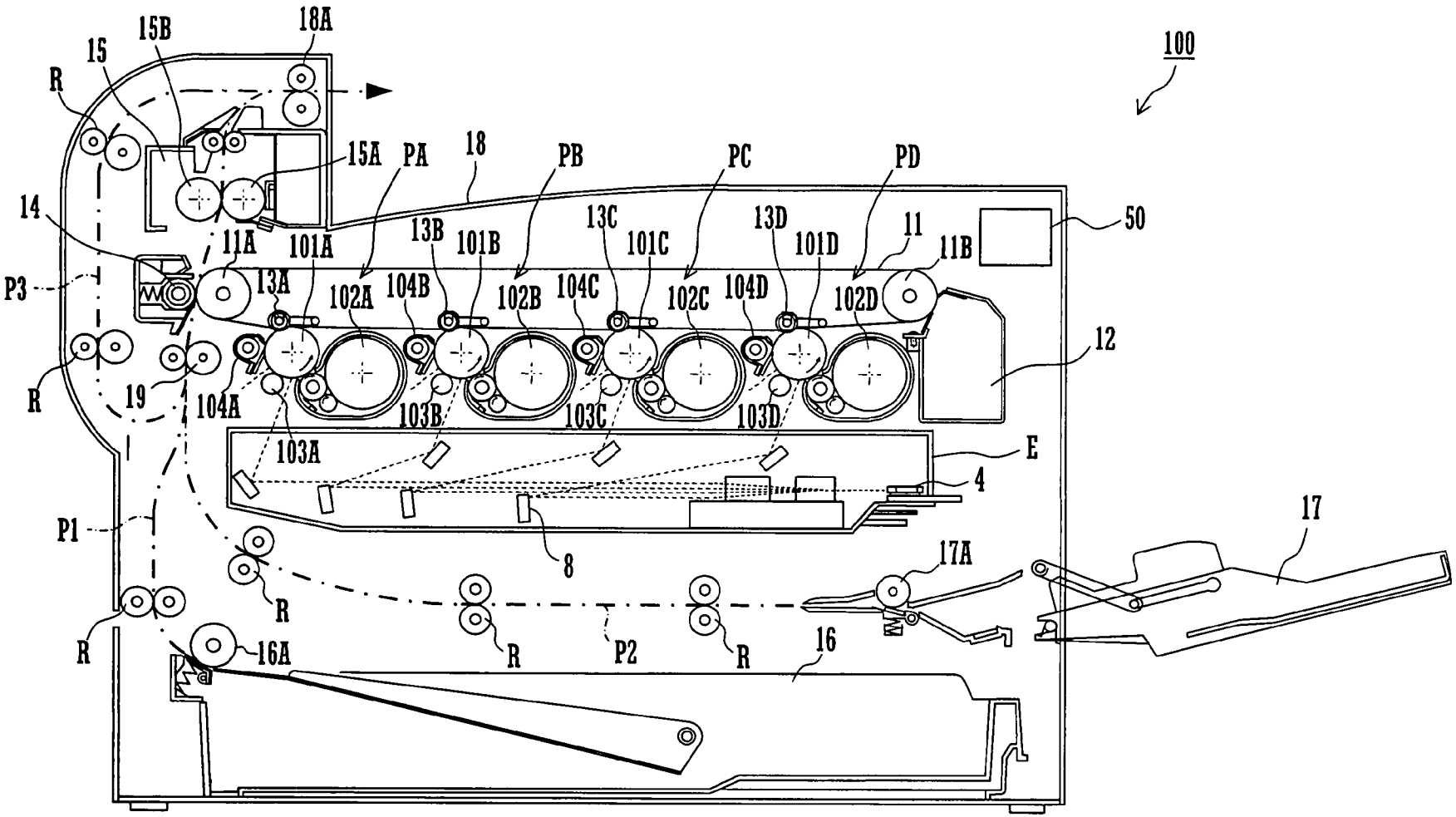
FIG. 2 is a sectional front view showing the structure of an image forming apparatus according to a preferred embodiment of the invention.

FIG. 2 is a sectional front view showing the structure of an image forming apparatus 100 according to a preferred embodiment of the invention. Having a full-color mode, a monochrome mode and a standby mode, the image forming apparatus 100 forms multicolor or monochrome images on sheets of such a recording medium as printing paper according to externally supplied image data. To perform such image forming operation, the image forming apparatus 100 includes an exposure unit E, photosensitive drums (image carrying members) 101A to 101D, developing units 102A to 102D, charging rollers 103A to 103D, cleaning units 104A to 104D, an intermediate image transfer belt (endless belt) 11, primary image transfer rollers 13A to 13D, a secondary image transfer roller 14, a fuser unit 15, sheet transport paths P1, P2 and P3, a paper cassette 16, a manual feed tray 17 and a delivery tray 18.

The image forming apparatus 100 performs the image forming operation by using image data corresponding to four colors which include the three subtractive primaries, that is, yellow (Y), magenta (M) and cyan (C) obtained by separating a full-color image, in addition to black (K). Accordingly, the image forming apparatus 100 are provided with four each photosensitive drums 101A to 101D, developing units 102A to 102D, charging rollers 103A to 103D, primary image transfer rollers 13A to 13D and cleaning units 104A to 104D as mentioned above for producing the original full-color image from the image data of the four colors. These elements of the image forming apparatus 100 are grouped to constitute four image forming sections PA, PB, PC, PD which are arranged in line along a turning direction (sub-scanning direction) of the intermediate image transfer belt 11.

The charging rollers 103A to 103D are contact-type charging devices for uniformly charging cylindrical surfaces of the photosensitive drums 101A to 101D to a specified potential level. As an alternative, contact charging devices using charging brushes or noncontact charging devices using charging wires, for example, may be employed instead of the contact charging rollers 103A to 103D. Including a semiconductor laser (not shown), a polygon mirror 4 and reflecting mirrors 8, the exposure unit E projects laser beams modulated by the image data of the four colors (black, cyan, magenta, yellow) upon the respective photosensitive drums 101A to 101D. As a result, latent images carrying black, cyan, magenta and yellow components are formed on the respective photosensitive drums 101A to 101D according to the image data for the four color components.

The developing units 102A to 102D supply developing agents (toners) onto the cylindrical surfaces of the respective photosensitive drums 101A to 101D to convert the latent images into visible toner images. The developing units 102A to 102D store black, cyan, magenta and yellow developing agents, respectively, and supply these developing agents onto the photosensitive drums 101A to 101D to visualize the latent images. The cleaning units 104A to 104D remove and collect residual toners from the surfaces of the respective photosensitive drums 101A to 101D upon completion of development and image transfer processes.

The intermediate image transfer belt 11 located above the photosensitive drums 101A to 101D forms a loop-shaped moving path suspended between a driving roller 11A and a driven roller 11B. An outer surface of the intermediate image transfer belt 11 faces at a lower half thereof the photosensitive drum 101D, the photosensitive drum 101C, the photosensitive drum 101B and the photosensitive drum 101A which are arranged in this order along the turning direction of the intermediate image transfer belt 11. The primary image transfer rollers 13A to 13D are located face to face with the photosensitive drums 101A to 101D, respectively, with the lower half of the intermediate image transfer belt 11 positioned in between. Areas where the cylindrical surfaces of the photosensitive drums 101A to 101D face the intermediate image transfer belt 11 are primary image transfer areas.

The intermediate image transfer belt 11 is an endless belt made of a film measuring approximately 100 to 150 micrometers thick and having a volume resistivity on the order of $10^{11}$ to $10^{12}$ ohm-centimeters. If the volume resistivity of the intermediate image transfer belt 11 is lower than this level, an accumulated static charge will leak off the intermediate image transfer belt 11 so that the intermediate image transfer belt 11 can not retain sufficient electrostatic energy needed for performing primary image transfer. If the volume resistivity of the intermediate image transfer belt 11 is higher than this level, on the contrary, there will arise a need for a dedicated discharging device for removing the residual static charge from a portion of the intermediate image transfer belt 11 that has passed over the individual primary image transfer areas.

To transfer the toner images formed on the cylindrical surfaces of the individual photosensitive drums 101A to 101D onto the intermediate image transfer belt 11, a primary image transfer bias (or electrostatic potential) of a polarity opposite to that of a static charge given to the toners is applied to the primary image transfer rollers 13A to 13D from a constant-voltage source. Consequently, the toner images of the individual colors (including black) formed on the photosensitive drums 101A to 101D are successively transferred one on top of another onto the outer surface of the intermediate image transfer belt 11 to produce a full-color toner image on the outer surface of the intermediate image transfer belt 11.

If image data for only part of the four colors (black, cyan, magenta, yellow) has been input, however, the latent image (s) and the toner image(s) are formed only on the photosensitive drum(s) 101, among the four photosensitive drums 101A to 101D, for which the image data has been input. When the monochrome mode is selected, for example, the latent image and the toner image are formed only on the photosensitive drum 101A for black and only the black toner image is transferred onto the outer surface of the intermediate image transfer belt 11.

Each of the primary image transfer rollers 13A to 13D includes a round bar made of a metallic material, such as stainless steel, measuring 8 to 10 millimeters in diameter of which curved outer surface is covered with an electrically conductive elastic material, such as ethylene-propylene-diene terpolymer (EPDM) or urethane foam. The primary image transfer rollers 13A to 13D are uniformly charged to a high voltage through the electrically conductive elastic material covering the curved outer surfaces.

The primary image transfer rollers 13A to 13D are mechanically biased against the photosensitive drums 101A to 101D in a direction differing from the normal to the cylindrical surface of each of the photosensitive drums 101A to 101D, respectively.

As the intermediate image transfer belt 11 turns, the toner image transferred onto the outer surface of the intermediate image transfer belt 11 at the primary image transfer areas is brought to a position facing the secondary image transfer roller 14. While the image forming apparatus 100 is performing the image forming operation, the secondary image transfer roller 14 is pressed against the outer surface of the intermediate image transfer belt 11 of which inner surface is held in contact with a curved outer surface of the driving roller 11A with a specified level of nipping pressure. When a sheet of printing paper fed from the paper cassette 16 or the manual feed tray 17 passes between the secondary image transfer roller 14 and the driving roller 11A, a high voltage of a polarity opposite to that of the static charge given to the toners is applied to the secondary image transfer roller 14. Consequently, the toner image is transferred from the outer surface of the intermediate image transfer belt 11 onto a surface of the sheet.

To maintain the specified level of nipping pressure between the secondary image transfer roller 14 and the intermediate image transfer belt 11, one of the secondary image transfer roller 14 and the driving roller 11A is made of a rigid material (e.g., metal) while the other is an elastic roller made of an elastic material (e.g., rubber or plastic foam).

The cleaning units 104A to 104D remove and collect residual toners which were attracted from the photosensitive drums 101A to 101D onto the intermediate image transfer belt 11 but not onto the sheet of printing paper to prevent color mixing in a succeeding image forming operation.

The sheet on which the toner image has been transferred is guided into the fuser unit 15 and passed between a heat roller 15A and a pressure roller 15B which together apply heat and pressure onto the sheet, whereby the toner image is firmly fixed, or fused, on the surface of the sheet. Then, the sheet carrying the fused toner image is discharged by a pair of delivery rollers 18A onto the delivery tray 18.

The image forming apparatus 100 has the aforementioned sheet transport path P1 which extends generally vertically for successively feeding sheets of printing paper stored in the paper cassette 16 upward between the secondary image transfer roller 14 and the intermediate image transfer belt 11 and through the fuser unit 15 onto the delivery tray 18. Along this sheet transport path P1, there are provided a pickup roller 16A for pulling and feeding each successive sheet into the sheet transport path P1 out of the paper cassette 16, transport rollers R for feeding the sheet upward along the sheet transport path P1, a pair of registration rollers 19 for temporarily halting the sheet transported along the sheet transport path P1 and advancing the sheet with proper timing to a secondary image transfer area located between the secondary image transfer roller 14 and the intermediate image transfer belt 11, and the aforementioned delivery rollers 18A for ejecting the sheet onto the delivery tray 18.

Also formed inside the image forming apparatus 100 is the aforementioned sheet transport path P2, along which a pickup roller 17A and transport rollers R are provided between the manual feed tray 17 and the registration roller pair 19. Further, the aforementioned sheet transport path P3 is formed between the registration roller pair 19 and the delivery roller pair 18A.

The delivery rollers 18A are supported rotatably in both forward and reverse turning directions. In a single-sided image forming mode in which an image is formed on only one side of a sheet, the image forming apparatus 100 causes the delivery rollers 18A to turn in the forward turning direction to eject the sheet onto the delivery tray 18 when the image has been printed on one side of the sheet. In a duplex (double-sided) image-forming mode in which first and second images are formed on front and reverse sides of a sheet, respectively, the image forming apparatus 100 causes the delivery rollers 18A to turn in the forward turning direction to eject the sheet onto the delivery tray 18 when the second image has been printed on the reverse side of the sheet.

When printing the first image on the front side of the sheet in the duplex image-forming mode, on the other hand, the image forming apparatus 100 causes the delivery rollers 18A to turn in the forward turning direction until a trailing edge of the sheet passes through the fuser unit 15. Then, when the delivery rollers 18A nip the trailing edge of the sheet, the image forming apparatus 100 causes the delivery rollers 18A to turn in the reverse turning direction to guide the sheet into the sheet transport path P3. Consequently, the sheet carrying the first image printed on one side (front side) only is guided back into the sheet transport path P1 with the front and reverse sides, and leading and trailing edges, of the sheet reversed.

The registration rollers 19 advance the sheet fed from the paper cassette 16 or the manual feed tray 17, or fed back into the sheet transport path P1 through the sheet transport path P3, to the secondary image transfer area located between the secondary image transfer roller 14 and the intermediate image transfer belt 11 with timing in synchronism with turning motion of the intermediate image transfer belt 11.

To synchronize the timing of advancing the sheet with the turning motion of the intermediate image transfer belt 11 and the photosensitive drums 101A to 101D, the registration rollers 19 are stopped for a while just before the intermediate image transfer belt 11 and the photosensitive drums 101A to 101D begin to turn again. While the registration rollers 19 are kept nonrotating and the intermediate image transfer belt 11 is at rest, the sheet fed from the paper cassette 16 or the manual feed tray 17, or fed back into the sheet transport path P1 through the sheet transport path P3, remains stationary (not advancing) in the sheet transport path P1 with the leading edge of the sheet held in contact with the registration rollers 19. Subsequently, the registration rollers 19 are caused to begin rotating at such a timing that the leading edge of the sheet aligns with a forward end of the toner image formed on the intermediate image transfer belt 11 (more exactly a leading edge of an image forming area on the intermediate image transfer belt 11) at the secondary image transfer area located between the secondary image transfer roller 14 and the intermediate image transfer belt 11.

Figure 3:
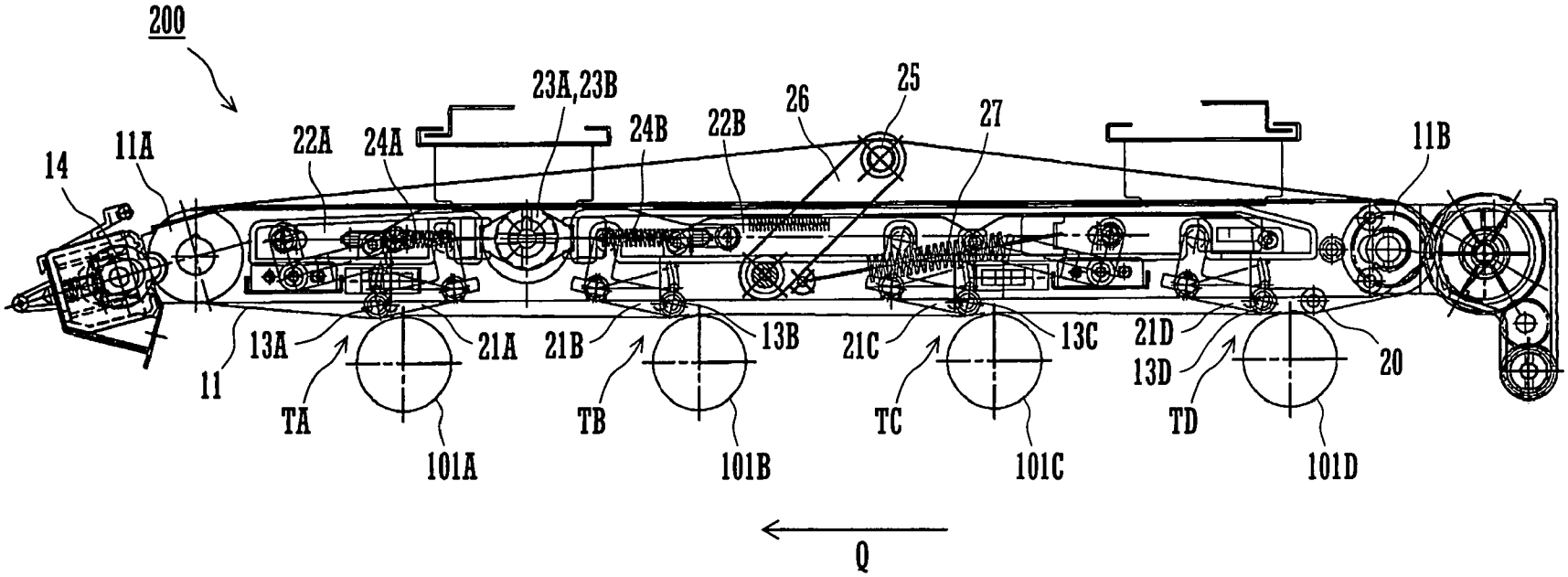
FIG. 3 is a front view of an image transfer unit used in the image forming apparatus of the embodiment.

FIG. 3 is a front view of an image transfer unit 200 used in the image forming apparatus 100 according to the embodiment of the invention. In the image transfer unit 200 of this embodiment, the aforementioned primary image transfer areas, which are designated by the letters TA, TB, TC and TD in FIG. 3, are located along the lower half of the intermediate image transfer belt 11 which forms a loop-shaped moving path suspended between the driving roller 11A and the driven roller 11B. The secondary image transfer roller 14 is mounted close to and downstream of the primary image transfer roller 13A which is disposed most downstream (among the primary image transfer rollers 13A to 13D) along the turning direction of the intermediate image transfer belt 11 indicated by an arrow Q.

The secondary image transfer roller 14 is so located to achieve a fast image forming speed by reducing the time required from the beginning of primary image transfer by the primary image transfer roller 13D which is disposed most upstream to the completion of secondary image transfer by the secondary image transfer roller 14 as well as a size reduction of the image forming apparatus 100 in the aforementioned structure of the image forming apparatus 100 in which the toner image is transferred from the intermediate image transfer belt 11 onto the sheet which is transported generally in a vertical direction.

The primary image transfer rollers 13A to 13D are located immediately downstream of the photosensitive drums 101A to 101D along the turning direction of the intermediate image transfer belt 11 at positions in the primary image transfer areas TA, TB, TC and TD, respectively, where the primary image transfer rollers 13A to 13D do not go into direct contact with the photosensitive drums 101A to 101D as the intermediate image transfer belt 11 is placed in between. The intermediate image transfer belt 11 is always forced by the primary image transfer rollers 13A to 13D in directions toward the photosensitive drums 101A to 101D.

Each of the primary image transfer rollers 13A to 13D is rotatably mounted at one end of each of L-shaped roller up/down arms 21A to 21D. The roller up/down arms 21A to 21D each have an L-shaped cross section as viewed along an axial direction of the primary image transfer rollers 13A to 13D, or along a direction perpendicular to the axial direction of the primary image transfer rollers 13A to 13D. Each of the roller up/down arms 21A to 21D is supported swingably about a shaft which is mounted at a bending part of the L-shaped cross section parallel to the axial direction of the primary image transfer rollers 13A to 13D. An upper end of the roller up/down arm 21A is linked to a sliding member 22A while upper ends of the roller up/down arms 21B to 21D are linked to a sliding member 22B.

The sliding members 22A and 22B are connected to a first rotary cam 23A and a second rotary cam 23B, respectively, which are arranged on a common axis. When the first and second rotary cams 23A, 23B rotate, peripheral surfaces of the two rotary cams 23A, 23B are displaced repeatedly so that the sliding members 22A and 22B are caused to move back and forth horizontally with the aid of springs 24A and 24B which exert elastic forces along a direction generally parallel to the direction of the arrow Q. Thus, as the sliding members 22A and 22B move back and forth horizontally, the roller up/down arms 21A to 21D swing, whereby the primary image transfer roller 13A moves alone between a lower position close to the photosensitive drum 101A and an upper position separated from the photosensitive drum 101A while the primary image transfer rollers 13B to 13D together move between lower positions close to the photosensitive drums 101B to 101D and upper positions separated from the photosensitive drums 101B to 101D, respectively.

Figure 4A:
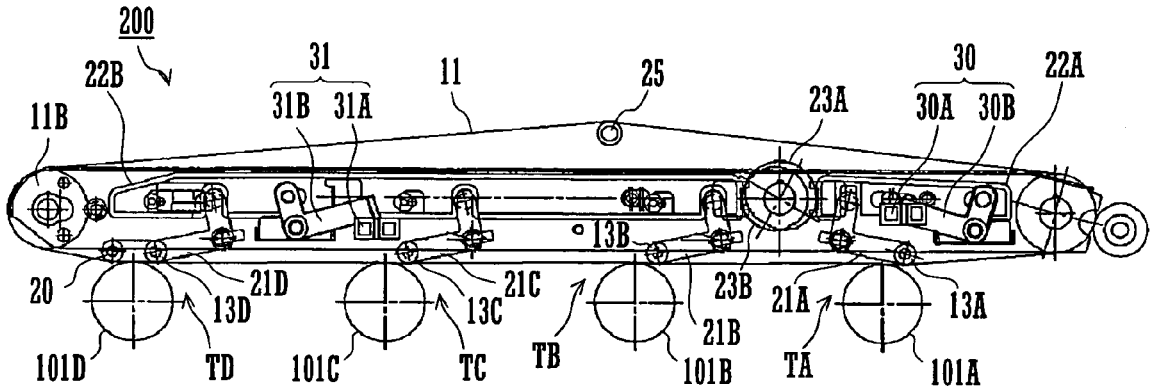
FIGS. 4A, 4B and 4C are rear views showing the structure of the image transfer unit used in the image forming apparatus of the embodiment.
Figure 4B:
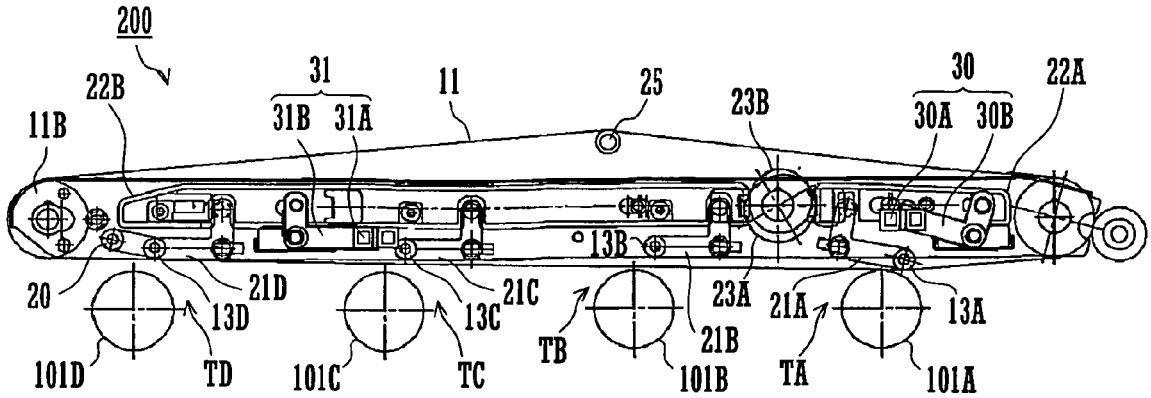
Figure 4C:
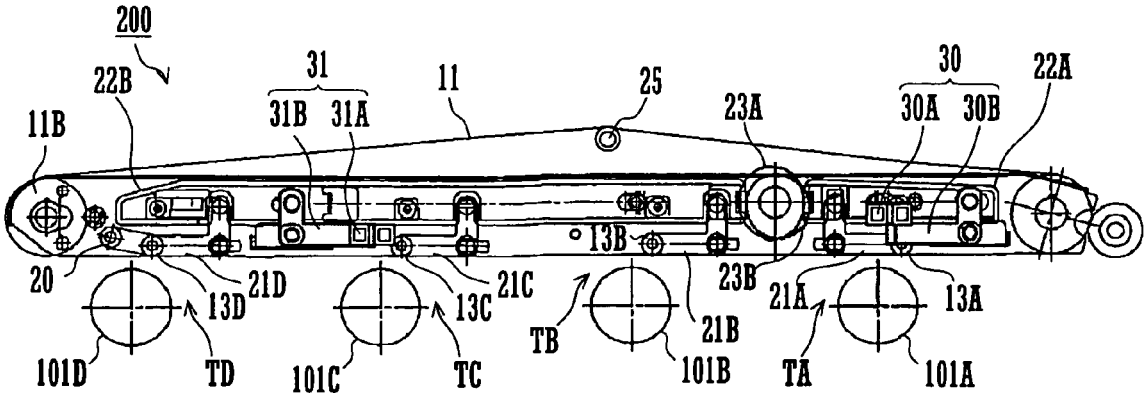

FIGS. 4A, 4B and 4C are rear views showing the structure of the image transfer unit 200 used in the image forming apparatus 100 according to the embodiment of the invention. When the image forming apparatus 100 is in the full-color mode for producing a full-color image, toner images formed on the individual photosensitive drums 101A to 101D are transferred onto the outer surface of the intermediate image transfer belt 11 at all of the primary image transfer areas TA, TB, TC and TD as shown in FIG. 4A. Therefore, all of the primary image transfer rollers 13A to 13D are at the lower positions close to the photosensitive drums 101A to 101D in the full-color mode so that the intermediate image transfer belt 11 is held in contact with all of the photosensitive drums 101A to 101D.

When the image forming apparatus 100 is in the monochrome mode for producing a monochrome image, a toner image formed on only the photosensitive drum 101A is transferred onto the outer surface of the intermediate image transfer belt 11 at the primary image transfer area TA as shown in FIG. 4B. Therefore, only the primary image transfer roller 13A is at the lower position close to the photosensitive drum 101A in the monochrome mode so that the intermediate image transfer belt 11 is held in contact with only the photosensitive drum 101A.

When the image forming apparatus 100 is in the standby mode in which the image forming apparatus 100 performs standby processing operation without forming any image, all of the image transfer rollers 13A to 13D are at the upper positions separated from the photosensitive drums 101A to 101D as shown in FIG. 4C, so that none of the photosensitive drums 101A to 101D are in contact with the intermediate image transfer belt 11.

The image transfer unit 200 can be removed from and fitted into the image forming apparatus 100 whenever necessary. Specifically, the image transfer unit 200 can be removed by pulling the same frontward out of the image forming apparatus 100 as illustrated in FIG. 2.

Figure 5:
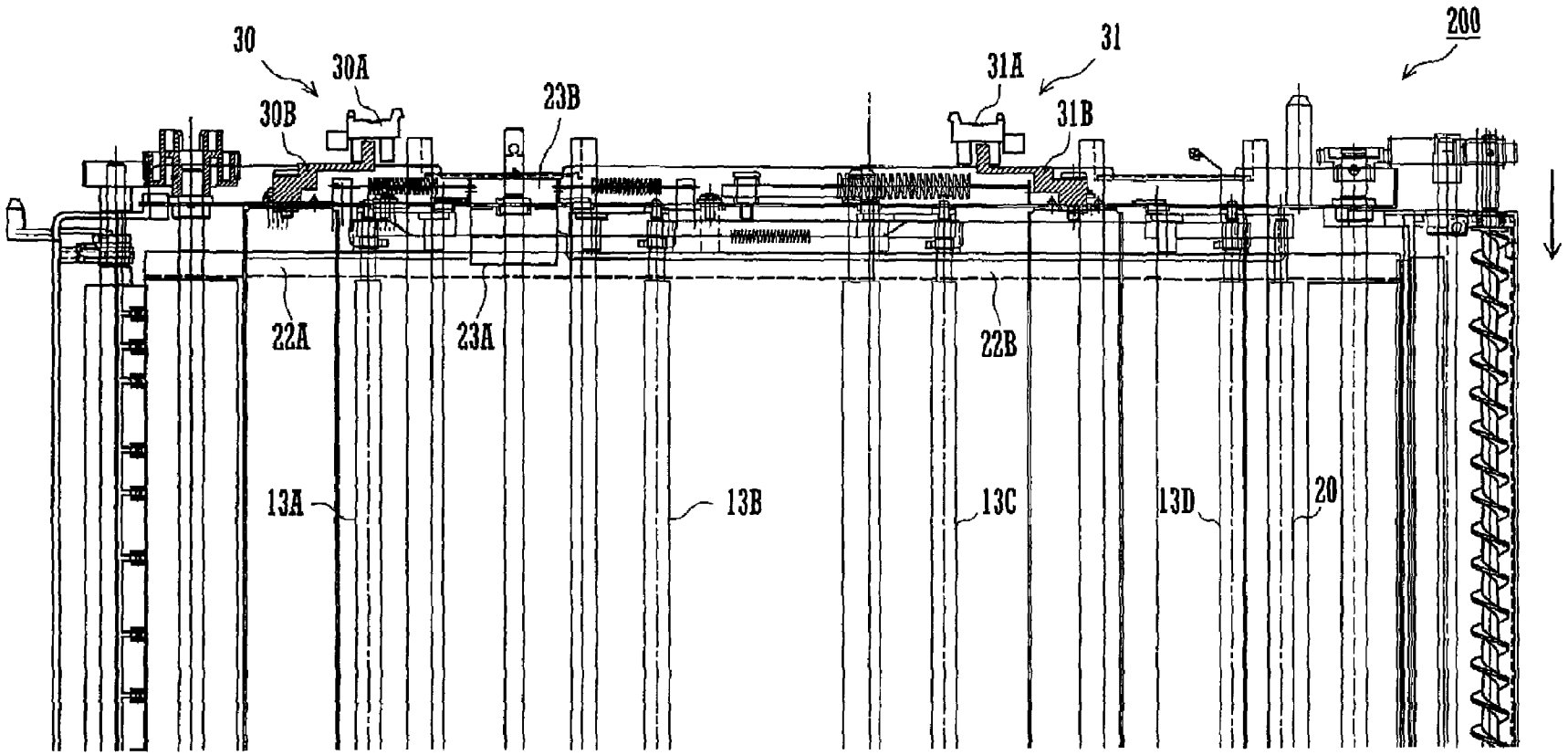
FIG. 5 is an enlarged top view showing part the structure of the image forming apparatus.

FIG. 5 is an enlarged top view showing part the structure of the image forming apparatus 100. The image forming apparatus 100 is further provided with a monochrome image forming sensor 30 and a full-color image forming sensor 31 which are disposed at the rear of the image transfer unit 200. The monochrome image forming sensor 30 includes an optical sensing device 30A for monochrome image forming disposed inside the image forming apparatus 100 and a generally L-shaped light shielding member 30B disposed on a rear side of the image transfer unit 200. Similarly, the full-color image forming sensor 31 includes an optical sensing device 31A for full-color image forming disposed inside the image forming apparatus 100 and a generally L-shaped light shielding member 31B disposed on the rear side of the image transfer unit 200.

These sensors 30, 31 work together to detect whether the image forming apparatus 100 is in the full-color mode, the monochrome mode or the standby mode from current locations of the sliding members 22A and 22B. The sensors 30, 31 also detect whether or not the image transfer unit 200 is installed in position inside the image forming apparatus 100.

When light emitted by the optical sensing device 30A is interrupted by the light shielding member 30B, the optical sensing device 30A outputs an "OFF" signal to a control unit 50 shown in FIG. 2. Also, when light emitted by the optical sensing device 31A is interrupted by the light shielding member 31B, the optical sensing device 31A outputs an "OFF" signal to the control unit 50. The optical sensing device 30A is mounted at a vertical position higher than the light shielding member 31B as can be seen from FIGS. 4A, 4B and 4C.

As illustrated in FIGS. 4A, 4B and 4C, one end (upper end) of the L-shaped light shielding member 30B is attached to the sliding member 22A. Likewise, one end (upper end) of the L-shaped light shielding member 31B is attached to the sliding member 22B. Each of the light shielding members 30B, 31B is supported swingably about a shaft which is mounted at a bending part of each of the light shielding members 30B, 31B parallel to the axial direction of the primary image transfer rollers 13A to 13D. As the sliding member 22A moves back and forth causing the light shielding member 30B to swing, the other end (free end) of the L-shaped light shielding member 30B moves between a shielding position where the light shielding member 30B interrupts the light emitted by the optical sensing device 30A and a retracted position where the light shielding member 30B does not interrupt the light emitted by the optical sensing device 30A. Also, as the sliding member 22B moves back and forth causing the light shielding member 31B to swing, the other end (free end) of the L-shaped light shielding member 31B moves between a shielding position where the light shielding member 31B interrupts the light emitted by the optical sensing device 31A and a retracted position where the light shielding member 31B does not interrupt the light emitted by the optical sensing device 31A.

When the image forming apparatus 100 is in the full-color mode, the light shielding member 30B of the monochrome image forming sensor 30 is located at the shielding position while the light shielding member 31B of the full-color image forming sensor 31 is located at the retracted position as shown in FIG. 4A. Thus, the optical sensing device 30A of the monochrome image forming sensor 30 outputs an "OFF" signal and the optical sensing device 31A of the full-color image forming sensor 31 outputs an "ON" signal as shown in FIG. 6 in this case.

When the image forming apparatus 100 is in the monochrome mode, the light shielding member 30B of the monochrome image forming sensor 30 and the light shielding member 31B of the full-color image forming sensor 31 are both located at the shielding positions as shown in FIG. 4B. Thus, the optical sensing device 30A of the monochrome image forming sensor 30 and the optical sensing device 31A of the full-color image forming sensor 31 individually output "OFF" signals as shown in FIG. 6 in this case.

When the image forming apparatus 100 is in the standby mode, the light shielding member 30B of the monochrome image forming sensor 30 is located at the retracted position while the light shielding member 31B of the full-color image forming sensor 31 is located at the shielding position as shown in FIG. 4C. Thus, the optical sensing device 30A of the monochrome image forming sensor 30 outputs an "ON" signal and the optical sensing device 31A of the full-color image forming sensor 31 outputs an "OFF" signal as shown in FIG. 6 in this case.

When the image transfer unit 200 is taken out of the image forming apparatus 100, the light shielding members 30B, 31B mounted on the image transfer unit 200 are also removed from the image forming apparatus 100, so that the optical sensing device 30A of the monochrome image forming sensor 30 and the optical sensing device 31A of the full-color image forming sensor 31 individually output "ON" signals as shown in FIG. 6.

When the image transfer unit 200 is removed, the image forming apparatus 100 can not perform any image forming job so that the image forming apparatus 100 is automatically set to the standby mode.

As is recognized from the foregoing discussion, it is possible to easily detect not only the currently selected mode but whether the image transfer unit 200 is installed in position in the image forming apparatus 100 with the two sensors 30, 31 alone. This makes it unnecessary to provide a dedicated sensing device for detecting whether the image transfer unit 200 is installed in position inside the image forming apparatus 100, making it possible to achieve a reduction in manufacturing cost and installation space requirement of the image forming apparatus 100.

When the sliding members 22A and 22B move back and forth horizontally, the free ends of the light shielding members 30B, 31B swing up and down. As it is possible to detect the free ends of the swinging light shielding members 30B, 31B by means of the optical sensing devices 30A, 31A, the image forming apparatus 100 of the embodiment can easily detect the currently selected mode and whether or not the image transfer unit 200 is installed in position with a simple structure, resulting in a further reduction in installation space.

Although the image forming apparatus 100 of the foregoing embodiment is structured such that the optical sensing devices 30A and 31A are mounted at different vertical positions so that the light shielding members 30B and 31B interrupt the light emitted by the optical sensing devices 30A and 31A at different vertical positions (shielding positions), the invention is not limited to this structure. What is essential to the purpose of this invention is that the retracted positions and the shielding positions of the light shielding members 30B, 31B are combined in different ways to create four different patterns of signals output from the two sensors 30, 31 indicating the currently selected mode and whether or not the image transfer unit 200 is installed in the image forming apparatus 100. For example, the aforementioned structure of the embodiment may be so modified that the optical sensing device 30A is mounted at the same vertical position as the optical sensing device 31A and the L-shaped light shielding members 30B and 31B are mounted in such a way that the free ends of the light shielding members 30B, 31B are oriented in the same direction from their bending parts.

The roller up/down arms 21A to 21D and the sliding members 22A and 22B are essential elements of image transfer part moving mechanisms of the invention.

In the image transfer unit 200 of the foregoing embodiment, the roller up/down arm 21D carries a pressure roller 20 supported rotatably about a shaft in addition to the primary image transfer roller 13D disposed at the primary image transfer area TD which is located most upstream among the primary image transfer areas TA, TB, TC and TD along the turning direction of the intermediate image transfer belt 11 indicated by an arrow Q, as illustrated in FIG. 3. Having the same outside diameter as the primary image transfer rollers 13A to 13D, the pressure roller 20 forces the intermediate image transfer belt 11 toward the photosensitive drum 101D to ensure that the intermediate image transfer belt 11 is pressed against the sheet of printing paper over the same nipping width (as measured along the turning direction Q of the intermediate image transfer belt 11) at the primary image transfer area TD as at the primary image transfer areas TA, TB and TC when the image forming apparatus 100 operated in the full-color mode.

As an example, a cylindrical outer portion of the pressure roller 20 is made of an insulating material so that the intermediate image transfer belt 11 is not grounded by the pressure roller 20. This is because it becomes impossible to create a sufficient primary image transfer electric field for transferring a toner image from the photosensitive drum 101D to the intermediate image transfer belt 11 if the intermediate image transfer belt 11 is grounded via the pressure roller 20 resulting in a loss of the primary image transfer bias (electrostatic potential) applied to the intermediate image transfer belt 11 through the primary image transfer roller 13D.

While the invention has thus far been described with reference to the preferred embodiment thereof, the aforementioned arrangements of the embodiment should be construed as being simply illustrative and not limiting the invention. The scope of the invention is shown solely by the appended claims, and not by the foregoing embodiment. It is to be understood that the invention is intended to cover the appended claims as well as all possible modifications of the embodiment and equivalents thereof which may occur to those skilled in the art within the spirit and scope of the invention.

What is claimed is:

1. An image forming apparatus having a full-color mode, a monochrome mode and a standby mode, said image forming apparatus comprising:

a removable image transfer unit which includes:

an endless belt forming a loop-shaped moving path;

a plurality of full-color image transfer rollers located inside the endless belt;

a monochrome image transfer roller located inside the endless belt;

a full-color image transfer part moving mechanism including a sliding member which moves back and forth generally parallel to a fixed turning direction of the endless belt to raise and lower the full-color image transfer rollers; and a monochrome image transfer part moving mechanism including a sliding member which moves back and forth generally parallel to the turning direction of the endless belt to raise and lower the monochrome image transfer roller;

a full-color image forming sensor for detecting the current position of the sliding member of the full-color image transfer part moving mechanism; and a monochrome image forming sensor for detecting the current position of the sliding member of the monochrome image transfer part moving mechanism;

wherein the moving path of the endless belt is selectively switched to one of three locations for the full-color mode, the monochrome mode and the standby mode as a result of ascending and descending motions of the full-color image transfer rollers and the monochrome image transfer roller; and wherein said image forming apparatus judges based on results of detection by the full-color image forming sensor and the monochrome image forming sensor whether said image forming apparatus is currently in the full-color mode for producing a full-color image, the monochrome mode for producing a monochrome image or the standby mode for performing standby processing operation and whether the image transfer unit is installed in said image forming apparatus.

2. The image forming apparatus according to claim 1, wherein the full-color image forming sensor includes a detectable member for full-color image forming which is attached to the full-color image transfer part moving mechanism and freely moves between a retracted position and a shielding position as the sliding member of the full-color image transfer part moving mechanism moves back and forth, and a full-color image forming sensing element disposed on a main body of said image forming apparatus for detecting the detectable member for full-color image forming when the detectable member is at the shielding position;

wherein the monochrome image forming sensor includes a detectable member for monochrome image forming which is attached to the monochrome image transfer part moving mechanism and freely moves between a retracted position and a shielding position as the sliding member of the monochrome image transfer part moving mechanism moves back and forth, and a monochrome image forming sensing element disposed on the main body of said image forming apparatus for detecting the detectable member for monochrome image forming when the detectable member is at the shielding position; and wherein the sensing element of the monochrome image forming sensor detects the detectable member for monochrome image forming only when said image forming apparatus is in the monochrome mode and in the full-color mode, whereas the sensing element of the full-color image forming sensor detects the detectable member for full-color image forming only when said image forming apparatus is in the monochrome mode and in the standby mode.

3. The image forming apparatus according to claim 2, wherein the detectable member for monochrome image forming is a generally L-shaped element having a bending part where the detectable member for monochrome image forming is supported swingably about a shaft which is mounted parallel to an axial direction of the monochrome image transfer roller with one end of the detectable member for monochrome image forming attached to the monochrome image transfer part moving mechanism on a rear side of the image transfer unit;

wherein the detectable member for full-color image forming is a generally L-shaped element having a bending part where the detectable member for full-color image forming is supported swingably about a shaft which is mounted parallel to an axial direction of the full-color image transfer rollers with one end of the detectable member for full-color image forming attached to the full-color image transfer part moving mechanism on the rear side of the image transfer unit; and wherein the monochrome image forming sensing element detects the other end of the detectable member for monochrome image forming, whereas the full-color image forming sensing element detects the other end of the detectable member for full-color image forming.

* * * * *